United States Patent [19]

Hayashi

[11] Patent Number: 4,963,054

[45] Date of Patent: Oct. 16, 1990

[54] FRAMES FOR CONSTRUCTING PAVEMENT BOARDS

[76] Inventor: Isao Hayashi, 10-15 Kanesawacho 1-Chome, Hitachi-shi, Ibaragi, Japan

[21] Appl. No.: 362,432

[22] PCT Filed: Sep. 14, 1988

[86] PCT No.: PCT/JP88/00928

§ 371 Date: Apr. 14, 1989

§ 102(e) Date: Apr. 14, 1989

[87] PCT Pub. No.: WO89/03453

PCT Pub. Date: Apr. 20, 1989

[51] Int. Cl.[5] ..... E01C 5/00

[52] U.S. Cl. ..... 404/34; 404/44; 52/302; 52/387

[58] Field of Search ..... 404/2, 43, 44, 73, 41, 404/34–37; 52/302, 387, 127.1, 386, 209, 477

[56] References Cited

U.S. PATENT DOCUMENTS

| | | | |
|---|---|---|---|
| 420,020 | 1/1890 | Schreyer | 404/44 |
| 2,030,556 | 2/1936 | Veltung | 404/47 |
| 2,475,708 | 7/1949 | Lichaczewski | 52/387 |
| 3,238,682 | 3/1966 | Tracy et al. | 404/37 |
| 3,520,095 | 7/1970 | Johason et al. | 52/387 |
| 3,832,078 | 8/1974 | Nakayama | 404/44 |
| 3,908,053 | 9/1975 | Hettich | 52/387 |
| 4,531,857 | 7/1985 | Bettigote | 404/44 |
| 4,531,859 | 7/1985 | Bettigole | 404/44 |
| 4,671,699 | 6/1987 | Roach | 404/36 |
| 4,858,410 | 8/1989 | Goldman | 52/387 |

FOREIGN PATENT DOCUMENTS

| | | | |
|---|---|---|---|
| 1130146 | 5/1962 | Fed. Rep. of Germany | 52/387 |
| 2447997 | 10/1980 | France | 404/36 |
| 94646 | 9/1959 | Norway | 404/37 |
| 2129468 | 5/1984 | United Kingdom | 404/73 |

*Primary Examiner*—Ramon S. Britts
*Assistant Examiner*—Gay Ann Spahn
*Attorney, Agent, or Firm*—Wenderoth, Lind & Ponack

[57] ABSTRACT

The present invention is a frame for constructing pavement boards in which plural sections having the bottom are divided, plural holes for draining water are made in the bottom, plural through holes in the directions of top and bottom are formed at the section walls of the above sections, respectively, the lower sides of the holes are opened and the upper sides of the holes are closed so as to be openable. The upper sides of the above through holes are closed so as to be openable by a thin film which is unitedly formed with the frame or an adhesion tape which is applied to the upper sides of the section walls.

Thus, the above frame can be obtained by the process in which concrete or mortar are poured into the sections, after hardening the concrete or the mortar, the upper sides of the through holes are opened by removing a little the upper sides of the section walls, or by stripping off the adhesion tape which is applied to the upper sides of the section walls, so that the frame can be used for producing the permeable pavement boards which are mainly made of concrete or mortar. The water permeability is secured by the above through holes.

3 Claims, 3 Drawing Sheets

FRAMES FOR CONSTRUCTING PAVEMENT BOARDS

TECHNICAL FIELD

The present invention relates to frames for constructing pavement boards which are permeable and mainly made of concrete or mortar.

BACKGROUND ART

At the present time, frames for constructing pavement boards, which are obtained by using frames as a means for constructing pavement boards, by pouring concrete or mortar into the frames, and by hardening the concrete or the mortar with the frames as an element for constructing pavement boards, are not proposed

DISCLOSURE OF INVENTION

The present invention is a frame for constructing pavement boards in which plural sections having the bottom are divided, plural holes for draining water are made in the bottom, plural through holes in the direction of top and bottom are formed at the section walls of the above sections, respectively, the lower sides of the holes are opened and the upper sides of the holes are closed so as to be openable.

The plane configuration, the size of length and breadth, the arrangement of each of the above sections and the like can be freely determined. The suitable height of the frames is nearly the same as the height of common pavement boards.

The suitable breadth of the above section walls is nearly the same or a little wider than the joint breadth of the pavement which is formed by common pavement boards.

The section configuration of the above through holes can be freely determined. Though it is described later, the section configuration of the through holes is preferably short or an oval having enough short minor axis so as to prevent the soil and stone of roads from going into the above through holes when the pavement boards which is constituted by the frames for constructing pavement boards are installed in the fixed pavement zone. Otherwise, the section configuration of the through holes is suitably rectangular The upper edge of the above through holes can be closed by a closing means having the intensity in which the upper edge is not easy to break when the mortar or the concrete is poured into the sections. Accordingly, for instance, the upper sides of the above through holes are closed by a thin film which is unitedly formed with the frames. Otherwise, the upper sides of the above through holes are closed by applying an adhesion tape which can be freely stripped off or stick on so as to open the upper sides. In any case, the closing of the upper sides of the above through holes may be conducted by a means which can open the upper sides by using simple operations. It is important to use a closing means which is easily openable by a way such as cutting with a file or a knife, melting by heating or tearing off so as to open the upper sides easily.

Preferably, a holding projection which keeps the packed mortar or the concrete after its hardening is provided near the center of the bottom of each of the above sections The upper part of the holding projection is spread out like a disk. Furthermore, at the bottom of each section wall of the above sections, ribs which radially extend from the center are preferably stood so as to reinforce the walls.

Moreover, it is preferable to form male connection parts and female connection parts which are connected with the male connection parts of the frames at the outer side of the frames.

Further, the frames and each of the constitution elements which are constituted in the frames are preferably formed in one united body by suitable plastics Then, the frames for constructing pavement boards of the present invention are used as follows Firstly, as described later, it is able to produce permeable pavement boards which are mainly made of concrete or mortar.

In the first process, the above frames are upwardly arranged in a suitable place and mortar or concrete are fully charged from the upper part into each section. Then, for example, a long ruler plate and the like is put on the top of each section wall so as to mediate between the walls, the plate is moved, and the mortar or the concrete protruding from the top of the section walls is removed. Thus, the upper surface of the mortar or the concrete charged in the sections of the frames are levelled.

At the bottom of each section, as described above, many holes for draining water are opened, so that water contained in the mortar or the concrete goes out through the holes to the outside of the frames Thus, the mortar or the concrete becomes dry and hardens well Furthermore, after the above mortar or the concrete hardens, as described above, when the holding projections are projectively provided at the center of the bottom, the mortar or the concrete is compactly fixed and it becomes difficult to separate from the sections.

Next, the upper sides of the through holes which is formed in each section walls are opened before the mortar or the concrete hardens thoroughly When the upper edge of the through holes are closed by a thin film which is unitedly formed with the frames, the upper sides is opened by cutting with a grinder and the like or by heating so as to melt the film. When the upper sides of the through holes are closed by an adhesion tape which is applied at the upper sides of the section walls, it is opened by stripping off the tape. In this case, at the same time or subsequently, it is preferable to cut with a grinder and the like so as to round the corners of the mortar or the concrete which contact with the section walls. Namely, it is preferable to mold the edges. Furthermore, when the above molding process with the glinder is omitted, or when the molding of the closing means of the upper edge of the through holes is unnecessary, the opening process of the upper edge of the through holes and the subsequent processes can be conducted after the mortar or the concrete hardens thoroughly.

Then, the mortar or the concrete hardens through sufficient curing process, and the permeable pavement boards whose main material is mortar or concrete are obtained.

Thus, the permeable pavement boards are constituted by the frames for constructing pavement board, precise size and configuration can be given very easily.

The permeable pavement boards, which are mainly made of mortar or concrete and constituted as described above, can be used by installing on a pavement and the like by the same method as common boards are used.

The following description illustrates the method more briefly.

The ground is properly constituted by permeable materials. Suitable materials are gravel and the like.

For instance, an installing zone is dug down a little, gravel is thrown into the zone and rolled, and then sand for leveling the ground is thrown. Then, the ground is rolled again to level the surface.

One of the above pavement boards which are mainly made of mortar or concrete is installed on the gravel ground as described above. Successively, a next pavement board is installed by connecting with the above installed pavement board at the outer sides of these boards. As described above, when connection male parts and connection female parts are formed at the outer sides of the frames, the connection female part of the next pavement board to be installed is connected with the connection male part which is formed at the outer side of the above installed pavement board, and plural pavement boards are arranged side by side in all directions on the above gravel ground. In this way, the pavement boards are installed all over the object zone.

Thus, by using the frames for constructing pavement boards of the present invention, the pavement boards are constituted. When roads and the like are paved by the pavement boards, as the through holes which are formed at the section walls of the pavement boards act as permeable holes, excellent permeable pavement is obtained.

BRIEF DESCRIPTION OF DRAWINGS

FIG. 1 is a portion broken plan view showing the frame for constructing pavement boards of the first working example of the present invention.

FIG. 2 is a section taken on line II—II in FIG. 1.

FIG. 3 is a plan view of the pavement boards which are constructed by pouring and hardening concrete in each section, and by opening through holes at the section walls.

FIG. 4 is a portion broken sectional view showing a condition in which the pavement boards are installed on the gravel ground.

FIG. 5 is a plan view showing a condition in which through holes are shown by tearing off partially the adhesion tape of the frames for constructing pavement boards of the second working example of the present invention.

FIG. 6 is a section taken on line VI—VI in FIG. 5.

BEST MODE FOR CARRYING OUT THE INVENTION

For describing the present invention more specifically, working examples based on the attached drawings are explained.

Firstly, the first working example of the present invention is explained.

Figure 1:
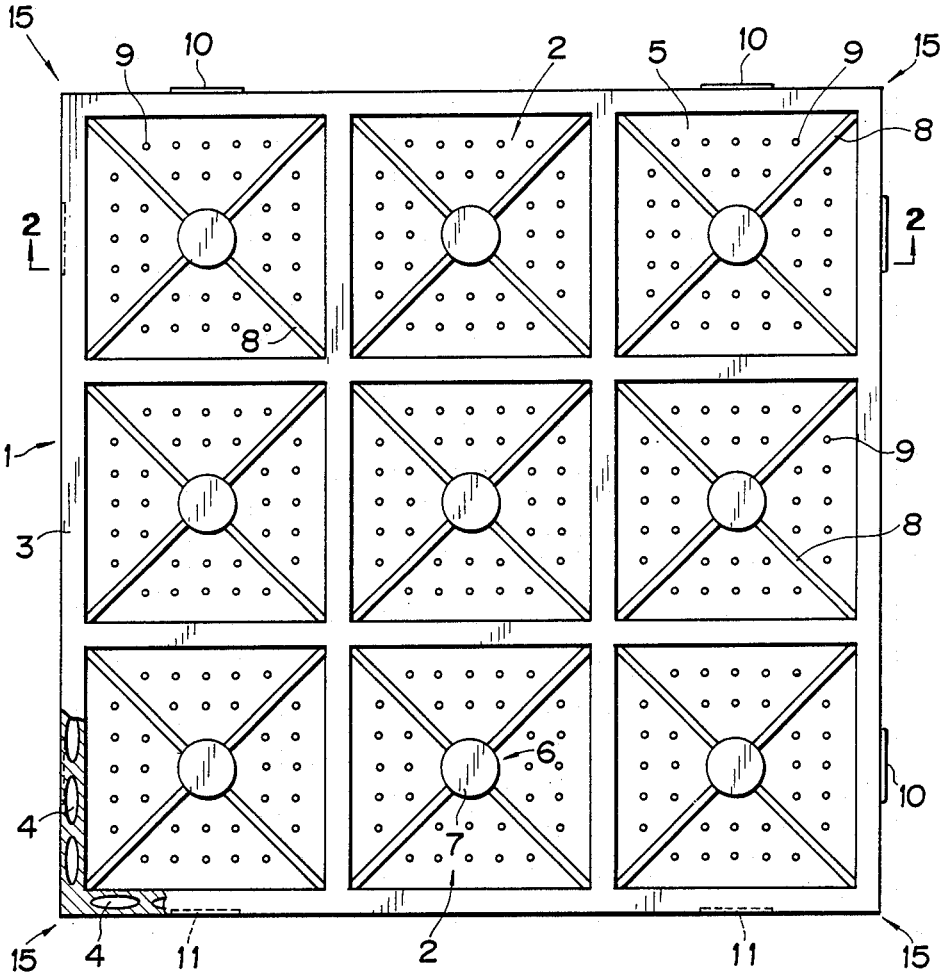
FIGS. 1 to 4 show the first working example of the present invention.
Figure 2:
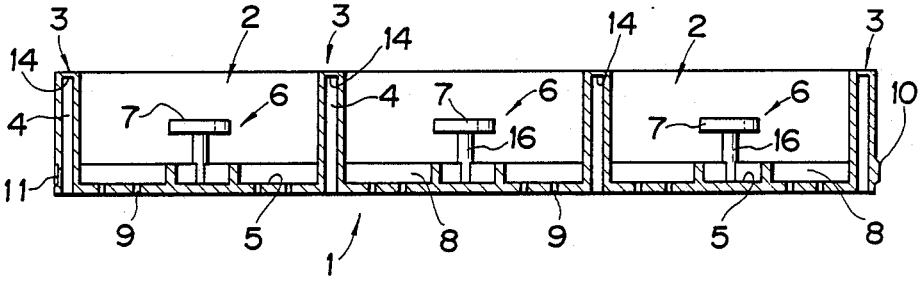

As shown in FIGS. 1 and 2, nine sections 2, 2 . . . having bottom parts are constructed in the directions of length and breadth in a plane square frame 1. In a section wall 3 which constitutes each of the above sections 2, 2 . . . , through holes 4, 4 . . . having an oval section configuration are formed. These holes are formed perpendicularly, and only the upper side is closed by a thin film 14 which is unitedly formed with the frame 1.

At the bottom 5 of each section 2, 2 . . . , a holding projection 6 stands in the center. The holding projection 6 is constituted by a piller 16 which is vertically provided in the center of the bottom 5 and a holding disk 7 which is arranged at the upper side of the piller.

Moreover, at the bottom 5 of each section 2, 2 . . . , four ribs 8, 8 . . . which radially extend from the lower part of the piller 16 of the above holding projection 6 and connect with the lower part of the section wall 3 are constructed. The above ribs 8, 8 . . . , as shown in FIG. 2 especially, are vertically formed at the bottom 5.

Furthermore, at the bottom 5, many drain holes 9, 9 which penetrate from the external surface to the inner surface are uniformly made.

Then, as shown in FIG. 1, two projected connection parts 10, 10 are contituted at two adjacent sides which contain one angle 15 of the frame 1, respectively. Two hollowed connection parts 11, 11 are constituted at two other adjacent sides, respectively The above projected connection parts 10, 10 are arranged at the outside of the sides of the above frame 1 corresponding to the sections 2, 2 which contain angles 15, 15, respectively. More particularly, the above projected connection parts 10, 10 are arranged at the lower parts of the outside of the sides corresponding to the center of each section 2, 2, and these connection parts take the form of a small projection having a square point The above hollowed connection parts 11, 11 are arranged at the outside of the other sides corresponding to the sections 2, 2 which contain angles 15, 15, respectively, at the position having similar relation to the above projected connection parts 10, 10. More particularly, the above hollowed connection parts 11, 11 are arranged at the lower parts of the outside of the sides corresponding to the center of each section 2, 2, the section of these connection parts take the form of a little larger square than the square point of the above projected connection parts, and the connection parts take the form of a little deeper hole than the length of the above projected connection parts 10, 10.

Moreover, the frame 1 and each constitution element which is formed with the frame are unitedly formed by plastic in which polypropylene is mainly contained and a weathering agent and the like are added.

As the frame 1 is constituted as described above, it is used as constitution materials for producing the pavement boards which are made of concrete or mortar, and the pavement having water permeability can be formed by the produced pavement boards Hereupon, the production method of the pavement boards made of concrete is exemplified. The production method of the pavement boards made of mortar is also the same.

Many frames 1, 1 . . . are upwardly placed in a working zone and concrete is poured from the upper part into the sections 2, 2 . . . . The concrete is fully charged in the sections 2, 2 . . . , if necessary, the concrete is shaked by a vibrator so that the concrete is fully spread in the sections 2, 2 . . . . The concrete pressed out from the section wall 3 is removed by the movement of a long ruler plate and the like which are put on the top of each section wall 3 so as to mediate between the walls. In this way, the upper surface of the concrete charged in the sections 2, 2 . . . is smoothly and very easily levelled and the height can be determined precisely.

The above process can be operated by automation. For example, a suitable conveyer equipment is used, the frames 1, 1 . . . are put on the conveyer in order, concrete is fully poured in the sections 2, 2 . . . on the way of conveyance, further, on the way of progress, the surface is levelled by removing the concrete pressed out over the section wall 3 by the same method as described above.

Furthermore, as many drain holes 9, 9 . . . are arranged at the bottom 5 of the sections 2, 2 . . . , water is easily moved by the drain holes 9, 9 . . . to the outside of the sections 2, 2 . . . in the course of the above process, and the subsequent hardening process is proceeded well. Moreover, as the holding projection 6 is projectively provided in the center of the bottom 5, the hardened concrete is securely held in the section 2, especially by the action of the holding disk 7.

Figure 3:
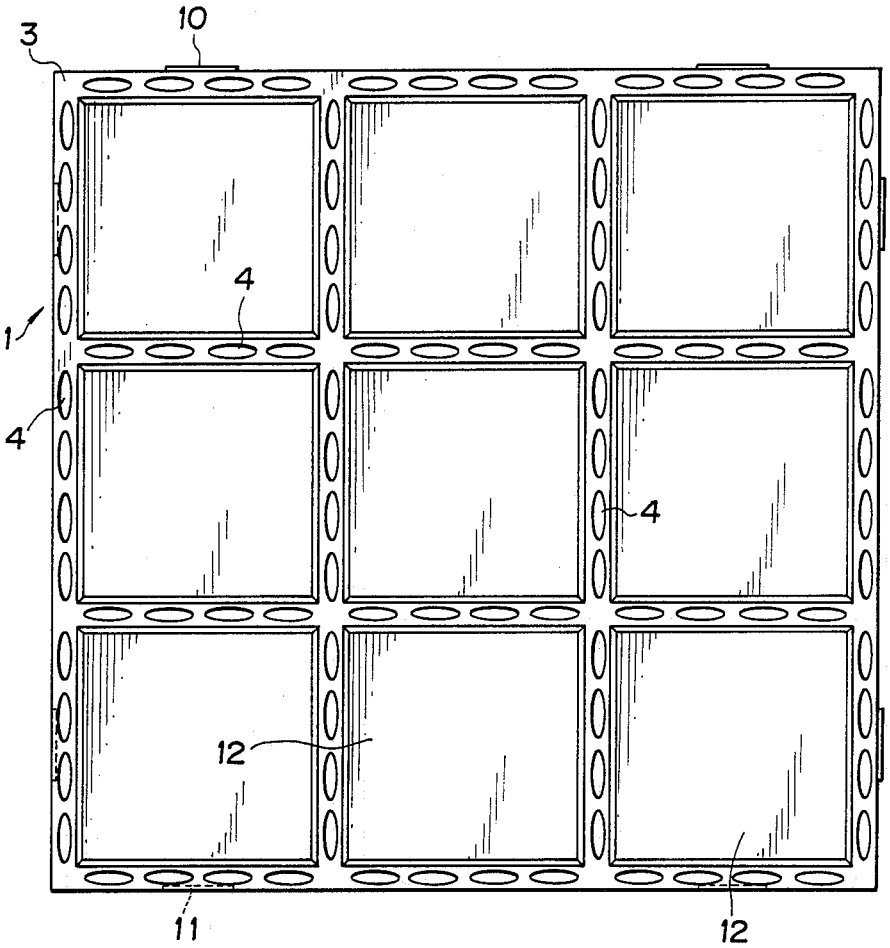
Figure 4:
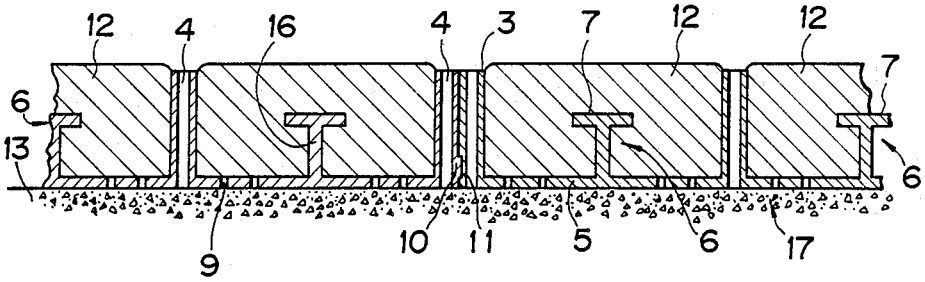

After the above concrete is hardened a little, the thin film 14 of the upper surface of the section wall 3 is removed with a grinder, and the upper sides of the through holes 4, 4 . . . are opened as shown in FIG. 3. At the same time, as shown in FIGS. 3 and 4, the edges of concrete pieces 12, 12 which have plane square configuration and stand at the both sides of the section wall 3 are chamfered by grinding a little.

Then, the concrete pieces 12, 12 . . . are left as they are, or these pieces are cured while sprinkling water or steam on them at intervals, and the finished pavement boards 17, 17 . . . made of concrete in which the concrete pieces 12, 12 . . . are fully hardened and have water permeability are obtained.

In such a process, the formed pavement boards 17, 17 . . . made of concrete can be used for a pavement installed on a pavement and the like by the same method as common boards, and permeable pavement can be created. The process is described in the following Firstly, a permeable ground is formed In this case, a gravel ground 13 is formed.

In the beginning, the object zone is dug down a little, gravel is thrown into the zone and rolled on the gravel by a roller, and sand for levelling the ground is arranged Then, the ground is rolled again to level the surface with the roller. In such a manner, the gravel ground 13 is formed Then, the above pavement boards 17, 17 . . . made of concrete, as shown in FIG. 4, are arranged side by side in all directions on the above gravel ground while the projected connection parts 10, 10 and the hollowed connection parts 11, 11 which are formed at the sides of the boards are connected. After the pavement boards are installed all over the object zone, a permeable pavement road is completed.

In such a permeable pavement road, rainwater and the like go down through the through holes 4, 4 . . . which are opened at the upper side of the section wall 3 to the gravel ground 13, and permeate through the gravel ground 13 and go underground.

Next, the second working example of the present invention is briefly explained.

In this example, the constitution is the same as in the first working example except that the upper sides of many through holes 24, 24 . . . are closed by an adhesion tape 34 which is applied on the upper surface of the section wall 3. Accordingly, the constitution and the action of the frames for constructing pavement boards of this example are explained in brief.

Figure 5:
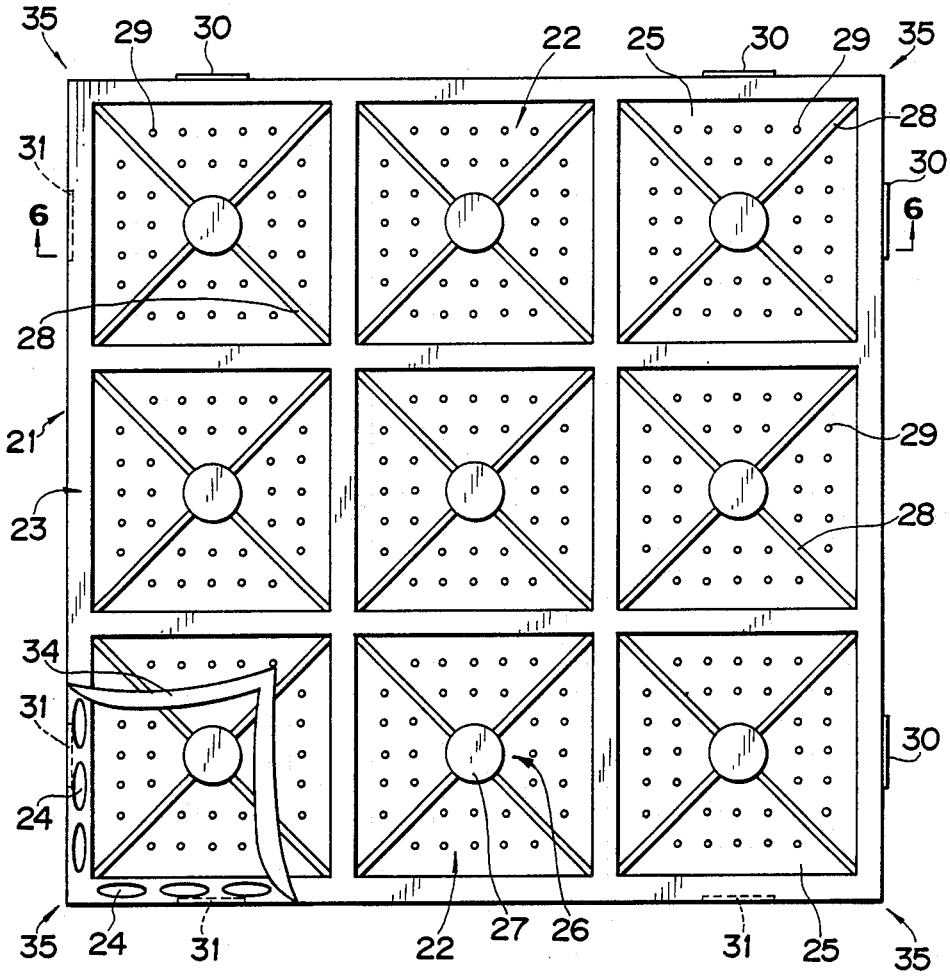
FIG. 5 and FIG. 6 show the second working example of the present invention.
Figure 6:
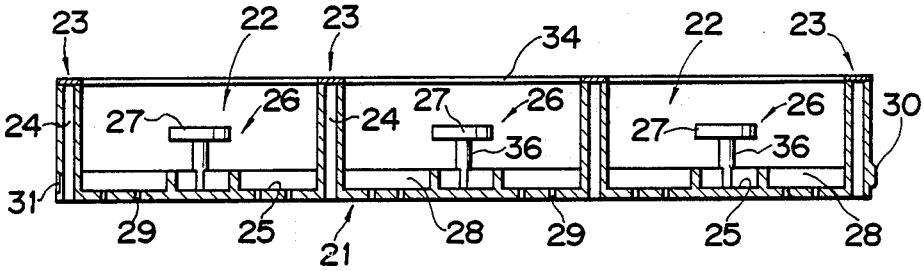

As shown in FIGS. 5 and 6, nine sections 22, 22 . . . are constructed in the directions of length and breadth in a plane square frame 21. In a section wall 23 which constitutes each of the above sections 22, 22 . . . , many through holes 24, 24 . . . having an oval section configuration are formed in the directions of top and bottom at regular intervals. Then, at the upper side of the above section wall 23, the adhesion tape 34 which has the same plane configuration as that of the upper side and can be freely stripped off or stick on is applied, and the upper side of the above through holes 24, 24 are closed so as to be openable easily.

At the bottom 25 of each section 22, 22 . . . , a holding projection 26 stands in the center. The holding projection 26 is constituted by a pillar 36 and a holding disk 27. Moreover, at the bottom 25 of each section 22, 22 . . . , four ribs 28, 28 . . . connected radially to the lower side of the section wall 23 by extending from the lower side of the piller 36 of the holding projection 26.

Furthermore, at the bottom 25, many drain holes 29, 29 . . . which penetrate from the external surface to the inner surface.

As shown in FIG. 5, two projected connection parts 30, 30 are constituted at two adjacent sides which contain one angle 35 of the frame 21, respectively, and two hollowed connection parts 31, 31 are constituted at other two adjacent sides, respectively.

Moreover, the frame 21 and each constitution element which is formed with the frame are unitedly formed by plastic in which polypropylene is mainly contained and a weathering agent and the like are added.

As the frame 21 is constituted as described above, the constitution is the same as in the first working example except that the upper sides of the through holes 24, 24 are closed by the adhesion tape 34. Accordingly, this example is the same as the first working example except that a part of the process in which the pavement boards made of concrete with the frame 21 are formed is different.

Then, the usage of the frame 21 which is different from the first working example is mainly explained.

This concerns a process for producing the pavement boards made of concrete with the frame 21.

As described in the first working example, concrete is charged in the sections 22, 22 . . . of the frames 21, 21 . . . , and the surface is levelled by removing the concrete pressed out over the upper side of the section wall 23.

Then, after the above concrete is hardened a little, the adhesion tape 34 which is applied on the surface of the section wall 23 is stripped off, the upper sides of each through holes 24, 24 . . . are opened. The above adhesion tape 34 can be stripped off in the later process, it can be easily stripped off in this process because the concrete is not completely hardened The process for stripping off the adhesion tape 34 is a characteristic process in the second working example, it is correspondent to the process for grinding the thin film 14 of the upper surface of the section wall 3 with the grinder in the first working example.

As the next process and the process for creating the permeable pavement of the pavement boards made by these processes are the same as in the above first working example, the description is omitted.

INDUSTRIAL APPLICATION

According to the present invention, the permeable pavement boards which are mainly made of concrete or mortar can be easily and precisely formed by using the present invention.

According to the pavement boards, the pavement having water permeability can be very easily created.

I claim:

1. A frame for use in forming a paving block, said frame comprising:

a plurality of side walls defining a plurality of adjacent upwardly open sections;

a bottom in each of said sections and having a plurality of openings therein for draining water therethrough from concrete or mortar poured thereinto;

said side walls each having a plurality of individual through holes therein spaced from each other along the length of said side walls and extending from the upper edges thereof to the bottom and opening out of said frame; and film means on the upper edges of said side walls for closing the upper ends of said holes and being easily removable for opening said holes;

whereby when concrete mortar is poured into said sections for filling them, said film means can be easily removed to open the upper ends of said through holes for, when the frames with the concrete or mortar therein are, after the concrete or mortar has hardened, laid side by side with like frames to form paving, the paving is permeable to water which can flow downwardly through said through holes.

2. A frame as claimed in claim 1 in which said film means is a thin film integral with the side walls and easily removed by the use of a tool appropriate for the material of the thin film.

3. A frame as claimed in claim 1 in which said film means is an adhesive tape.

* * * * *